US007673443B2

(12) United States Patent
Rodatz et al.

(10) Patent No.: US 7,673,443 B2
(45) Date of Patent: Mar. 9, 2010

(54) METHOD AND A DEVICE FOR PROVIDING LAMBDA CONTROL IN AN INTERNAL COMBUSTION ENGINE

(75) Inventors: Paul Rodatz, Landshut (DE); Gerd Rösel, Regensburg (DE); Hong Zhang, Tegernheim (DE)

(73) Assignee: Siemens Aktiengesellschaft, Munich (DE)

( * ) Notice: Subject to any disclaimer, the term of this patent is extended or adjusted under 35 U.S.C. 154(b) by 273 days.

(21) Appl. No.: 11/667,570

(22) PCT Filed: Oct. 6, 2005

(86) PCT No.: PCT/EP2005/055056

§ 371 (c)(1),
(2), (4) Date: May 11, 2007

(87) PCT Pub. No.: WO2006/053802

PCT Pub. Date: May 26, 2006

(65) Prior Publication Data

US 2007/0295000 A1 Dec. 27, 2007

(30) Foreign Application Priority Data

Nov. 16, 2004 (DE) ..... 10 2004 055 231

(51) Int. Cl.
*F01N 3/00* (2006.01)

(52) U.S. Cl. ..... 60/274; 60/276; 60/277; 60/285

(58) Field of Classification Search ..... 60/274, 60/276, 277, 285
See application file for complete search history.

(56) References Cited

U.S. PATENT DOCUMENTS

| | | | | |
|---|---|---|---|---|
| 3,945,204 | A * | 3/1976 | Knapp | 60/274 |
| 5,365,216 | A * | 11/1994 | Kotwicki et al. | 340/439 |
| 6,024,792 | A | 2/2000 | Kurz et al. | |
| 6,092,413 | A * | 7/2000 | Busch et al. | 73/114.73 |
| 6,799,422 | B2 * | 10/2004 | Westerbeke et al. | 60/289 |
| 6,828,156 | B2 * | 12/2004 | Ohsuga et al. | 436/135 |
| 6,925,372 | B2 * | 8/2005 | Yasui | 701/109 |
| 2004/0010364 | A1 | 1/2004 | Yasui et al. | |

FOREIGN PATENT DOCUMENTS

| | | |
|---|---|---|
| DE | 102 48 842 A1 | 4/2004 |
| JP | 58048756 A | 3/1983 |

* cited by examiner

*Primary Examiner*—Binh Q Tran
(74) *Attorney, Agent, or Firm*—King & Spalding L.L.P.

(57) ABSTRACT

Method for lambda control in an internal combustion engine with a catalytic converter in an exhaust tract and at least one lambda probe mounted inside the catalytic converter. With this arrangement of the upstream probe there are signal delays which slow down the lambda control. To compensate, the measurement signals from the first lambda probe are applied to a lambda analysis unit which corrects measurement signal delays, and the corrected lambda probe signal is applied to a unit for lambda control. Both lambda probes are connected to a unit for lambda control.

10 Claims, 1 Drawing Sheet

METHOD AND A DEVICE FOR PROVIDING LAMBDA CONTROL IN AN INTERNAL COMBUSTION ENGINE

CROSS REFERENCE TO RELATED APPLICATIONS

This application is the US National Stage of International Application No. PCT/EP2005/055056, filed Oct. 6, 2005 and claims the benefit thereof. The International Application claims the benefits of German application No. 10 2004 055 231.2 filed Nov. 16, 2004, both of the applications are incorporated by reference herein in their entirety.

FIELD OF INVENTION

The present invention relates to a method and a device for providing lambda control in an internal combustion engine in the case of which provision has been made for at least one lambda probe arranged just after the volume of a catalytic converter.

BACKGROUND OF THE INVENTION

In order to adhere to the emission limits which are applicable at present, a catalytic after-treatment of the exhaust gases is required. The mixture, which consists of fuel and air, is characterized by the so-called lambda air ratio, which indicates the ratio of the current air-to-fuel mixture during combustion in the cylinder. Different lambda probes are known for measuring the concentration of oxygen in the exhaust gas. For the most part, said probes can be divided into binary and linear lambda probes. In the case of $\lambda=1$, the binary lambda probe output voltage fluctuates. In the case of the linear lambda probe, deviations from $\lambda=1$ are proportionate to the output signal.

Irrespective of the type of lambda probe used, the standard configuration for a lambda probe consists of a pre-catalytic converter sensor, a catalytic converter, and possibly a post-catalytic converter sensor. The pre-catalytic converter and the post-catalytic converter sensors are also referred to as an upstream oxygen sensor or as a downstream oxygen sensor.

A disadvantage of this arrangement is the fact that the sensor and the catalytic converter have to be built in as separate units in the exhaust gas tract.

SUMMARY OF INVENTION

The engineering object underlying this invention is thus to make available a method and a device for lambda control which supplies, for an improved arrangement of the lambda sensor and the catalytic converter, a significant control accuracy and a sufficiently high control speed for the lambda value.

This object is achieved in accordance with the invention by means of the method with the features of the claims. Advantageous embodiments of the invention are the subject of the subclaims.

The method according to the invention for providing lambda control in an internal combustion engine uses a signal analysis unit for the measurement signals from the first lambda probe which, referred to the direction of the gas flow of the exhaust gases, is arranged upstream in the exhaust gas tract. Unlike known pre-catalytic converter probes, said first lambda probe is not arranged ahead of the catalytic converter, but inside the catalytic converter, so that it is positioned downstream of the partial volume of a catalytic converter. The measurement signals from the first lambda probe are applied to a signal analysis unit, which corrects a delay in the measurement signal through the partial volume of a catalytic converter. The corrected measurement signal from the lambda probe is then applied to a lambda control. The invention is based on the knowledge that a probe arranged upstream inside a catalytic converter has a considerable signal delay compared with the curve of a pre-catalytic converter probe. Such a signal delay does not only consist of purely chasing the measurement signals, but can also intervene in the signal curve. Up to now, with this arrangement of the upstream probe there are signal delays, which clearly slow down the speed of the lambda control and, no doubt, approximately by the duration of a plateau phase described lower down. Only the corrected measurement signal of the upstream lambda probe still allows a reliable lambda control. In this way, the signal analysis unit allows the use of a first lambda probe that is arranged inside the catalytic converter, and as a result, the arrangement of the catalytic converter and the probe can be simplified.

The signal analysis unit itself preferably analyzes the curve in time of the signal change in the measurement signals together with the value of the measurement signals. This method of signal analysis is based on the consideration that when a measurement probe arranged upstream of the catalytic converter has reached its saturation value, i.e. its output signals have reached a plateau, then the signal values from a lambda probe arranged inside a catalytic converter also reach a plateau value. Therefore, a decrease in the signal values can be used to determine a point in time at which a pre-catalytic converter probe has already reached its saturation value. This signal value is relayed by the signal analysis unit to the lambda control, so that no delay occurs.

The signal analysis unit analyzes the gradients of the measurement signals, to determine the point in time at which the gradient flattens to a predetermined value in a preferred manner. This point in time is relayed by the signal analysis unit to the lambda control as the point in time for the $\lambda=1$ passage of a probe arranged upstream of the catalytic converter.

This engineering object is likewise achieved by means of a device for an internal combustion engine with the features of the claims.

The device has a catalytic converter arranged in the exhaust gas tract, a first lambda probe which is arranged inside the catalytic converter, a second lambda probe that is preferably arranged downstream of the first lambda probe, and a signal analysis unit which corrects a delay in the signals from the first lambda probe and applies the corrected signals to a unit for lambda control. In the case of the device according to the invention, the second lambda probe is likewise arranged inside the catalytic converter, and as far as possible downstream. Alternatively, the second lambda probe can also be arranged outside the catalytic converter. The signal analysis unit that has been provided in the case of the inventive device can function as the first lambda probe both in the case of a binary lambda probe and in the case of a linear lambda probe.

BRIEF DESCRIPTION OF THE DRAWINGS

The invention is described in more detail below with reference to the two figures. They are as follows.

DETAILED DESCRIPTION OF INVENTION

The invention relates to a lambda control for configuring the lambda probe and the catalytic converter in which the lambda probe is arranged just after the volume of a catalytic converter. The control probe, i.e. the upstream lambda probe involved is thus a so-called lambda sensor catalytic converter. The inventive method achieves an increase in the control speed of the lambda control for the control probe arranged inside the catalytic converter. This is achieved by a signal analysis, which completely or at least partially cancels the delay in the measurement signals determined by the volume of a catalytic converter and for this reason clearly accelerates the control behavior of the lambda control compared with that of the uncompensated method. The influence of the partial volume of a catalytic converter, which lies upstream of the control probe and thereby influences its measurement results, is eliminated to such an extent by correcting the delay that the control speed of a known lambda control is achieved.

Figure 1:
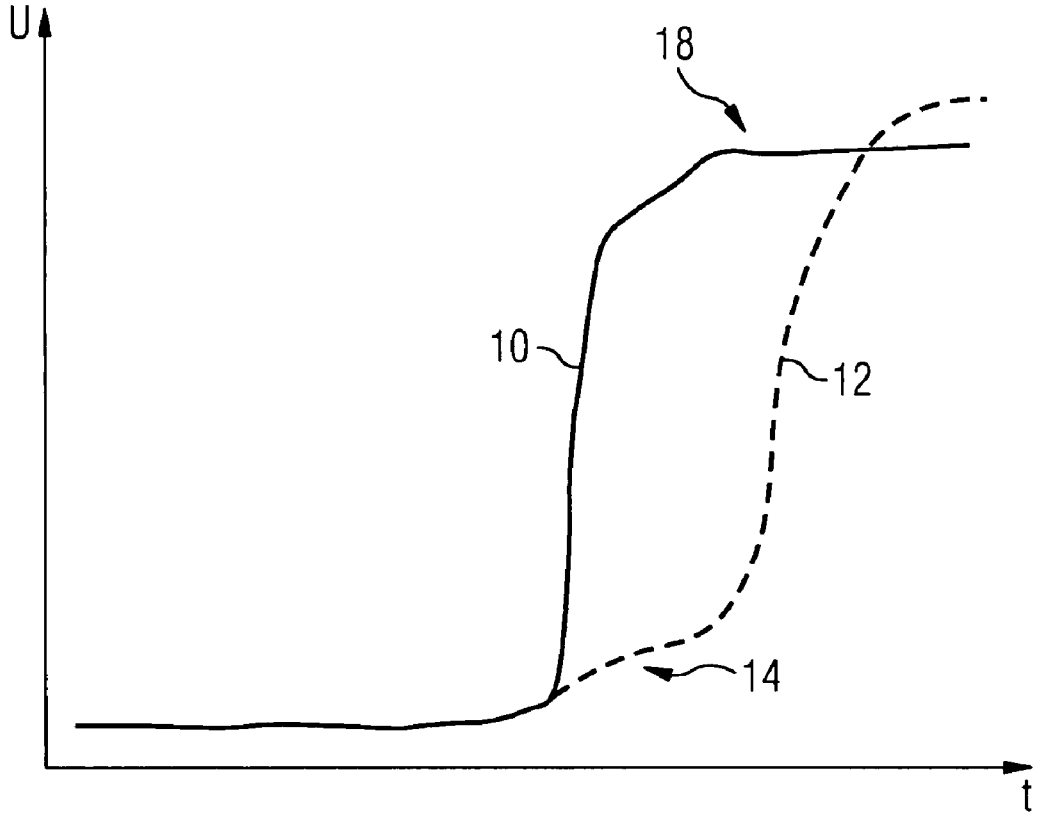
FIG. 1 a schematic view of two signal curves over time.

FIG. 1 shows the typical measurement curve of probe signals, for a lambda control for example. The solid line 10 corresponds to a signal VLS_UP of a binary oxygen probe arranged ahead of the volume of a catalytic converter. It can be seen clearly that the signal changes suddenly towards a new value. A broken line is used to represent the signal curve 12 of a binary oxygen probe, which is arranged inside the catalytic converter and, in this way, arranged just after a partial volume of the catalytic converter. It can also be seen clearly that this signal curve is considerably delayed compared with that of the signal curve 10. Examples of measurements referred to the passage through the 450 mV point, resulted in a delay of up to 600 ms. However, an exact analysis of the signals 12 has shown that the signal 12 reaches a plateau marked with the number 14, which is more or less reached at the same time as a plateau 18 of the pre-catalytic converter probe. This knowledge leads to the analysis of a change in the signal VLS_POST 12 down to the plateau 14 and because of this, a delay in the lambda control is prevented. This is undertaken by preferably analyzing the differences in the changes, i.e. for example the first derivative in time of the signals VLS_POST are analyzed in addition to the absolute value of the signals by the signal analysis unit.

This method can also be used for linear control probes, in which case even higher signal gradients than those of binary probe are observed here, which further improves the accuracy of the method.

The inventive method almost completely compensates for, in both the linear and the binary lambda probes, the disadvantages of the signal speed resulting from the use of the lambda probe inside the catalytic converter, because the corrected signal analysis of the lambda signals produces an almost unchanged control speed compared with that of the conventional application of a probe arranged ahead of the catalytic converter. For this reason, the advantages of the lambda sensor catalytic converter can be utilized, and at the same time, the same performance can be achieved as in the standard configuration composed of an upstream oxygen sensor, a catalytic converter and, if required; a downstream oxygen sensor. With the device according to the invention, both the catalytic converter design and the precious metal load can be retained and an enlargement of the catalytic converter to increase the control speed can be avoided.

Figure 2:
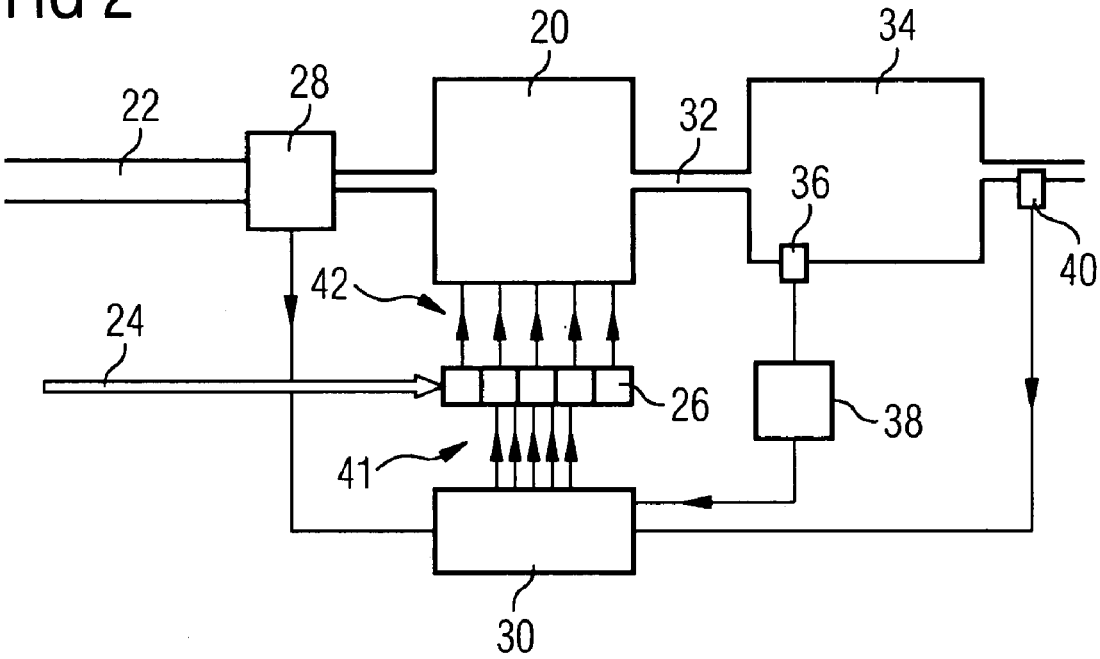
FIG. 2 a schematic view of a lambda control with a first lambda probe inside the catalytic converter.

FIG. 2 shows schematically the design of the lambda control device according to the invention. An internal combustion engine is designated in the diagram with the number 20. Air is fed into the internal combustion engine through an intake tract 22. Fuel is fed into the individual cylinders (not shown) of the internal combustion engine 20 through both the line 24 and the injection valves 26. It is well known that a mass air flow sensor 28 measures the flowing-in mass air flow and relays the measured value to a control unit 30 for lambda control. In this way, the exhaust gases from the internal combustion engine 20 arrive inside the catalytic converter 34 through the exhaust gas tract 32. The catalytic converter 34 has a lambda probe 36, which is arranged inside the catalytic converter 34. The lambda probe 36 relays the measured signals to a signal analysis unit 38 and from where said signals are applied to a control unit 30. Provision has been made for a second lambda probe 40 arranged downstream of the catalytic converter 34, the signals of which are likewise applied to a control unit 30. The signals of the second lambda probe usually serve to compensate for contamination and ageing phenomena at the first lambda probe and, therefore, the second lambda probe is not imperative for the invention. The control unit 30 generates cylinder-specific signals 41 to control 42, the internal combustion engine.

The invention claimed is:

1. A method for providing lambda control in an internal combustion engine having a catalytic converter arranged in an exhaust gas tract and a first lambda probe arranged inside the catalytic converter and connected to a control unit for lambda control, but not having a lambda probe arranged upstream of the catalytic converter, the method comprising:

applying measurement signals from the first lambda probe arranged inside the catalytic converter to a lambda analysis unit;

the lambda analysis unit correcting a delay in the measurement signals from the first lambda probe arranged inside the catalytic converter as compared with a known signal curve from a conventional lambda probe arrangement upstream of the catalytic converter; and applying the corrected lambda probe signal to a control unit for lambda control, such that the first lambda probe arranged inside the catalytic converter eliminates the need for a lambda probe arranged upstream of the catalytic converter.

2. The method as claimed in claim 1, wherein a change in the measurement signals in time is analyzed together with the measurement signal by the signal analysis unit.

3. The method as claimed in claim 1, wherein the signal analysis unit analyzes the increase in the measurement signals and when a predetermined change value is reached, it applies a signal to the lambda control that indicates a predetermined value of a lambda sensor arranged ahead of the catalytic converter.

4. A device for providing lambda control in an internal combustion engine, comprising:

a catalytic converter arranged in an exhaust gas tract of the engine;

a first lambda probe arranged inside the catalytic converter, and without a pre-catalytic converter probe arranged upstream of the catalytic converter; and a signal analysis unit where a delay in the signals from the first lambda probe arranged inside the catalytic converter as compared with known signals from a conventional lambda probe arrangement upstream of the catalytic converter is corrected and the corrected signals are applied to a control unit for lambda control, such that the first lambda probe arranged inside the catalytic converter eliminates the need for a pre-catalytic converter lambda probe arranged upstream of the catalytic converter.

5. The device as claimed in claim 4, wherein a second lambda probe is arranged downstream of the first lambda probe.

6. The device as claimed in claim 5, wherein the second lambda probe is arranged inside the catalytic converter.

7. The device as claimed in claim 5, wherein the second lambda probe is arranged outside the catalytic converter.

8. The device as claimed in claim 4, wherein the first lambda probe is a binary lambda probe.

9. The device as claimed in claim 4, wherein th first lambda probe is a linear lambda probe.

10. An internal combustion engine, comprising:

an air intake tract connected to a cylinder of the engine;

an exhaust gas tract connected to the cylinder that exhausts waste gas from the cylinder;

a catalytic converter arranged in the exhaust gas tract;

a first lambda probe arranged inside the catalytic converter, and without a pre-catalytic converter lambda probe arranged upstream of the catalytic converter;

a signal analysis unit where a delay in the signals from the first lambda probe arranged inside the catalytic converter as compared with known signals from a conventional lambda probe arrangement upstream of the catalytic converter is corrected and the corrected signals are applied to a control unit for lambda control, such that the first lambda probe arranged inside the catalytic converter eliminates the need for a pre-catalytic converter lambda probe arranged upstream of the catalytic converter.

* * * * *